US011377882B2

(12) United States Patent
Schiffer

(10) Patent No.: US 11,377,882 B2
(45) Date of Patent: Jul. 5, 2022

(54) MOTOR VEHICLE LOCK

(71) Applicant: Kiekert AG, Heiligenhaus (DE)

(72) Inventor: Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 705 days.

(21) Appl. No.: 16/312,379

(22) PCT Filed: Jun. 13, 2017

(86) PCT No.: PCT/DE2017/100495
§ 371 (c)(1),
(2) Date: Dec. 21, 2018

(87) PCT Pub. No.: WO2018/006896
PCT Pub. Date: Jan. 11, 2018

(65) Prior Publication Data

US 2019/0226246 A1 Jul. 25, 2019

(30) Foreign Application Priority Data

Jul. 4, 2016 (DE) ..... 10 2016 112 185.1

(51) Int. Cl.
*E05B 81/06* (2014.01)
*E05B 81/50* (2014.01)
(Continued)

(52) U.S. Cl.
CPC ..... *E05B 81/06* (2013.01); *E05B 77/02* (2013.01); *E05B 81/14* (2013.01); *E05B 81/34* (2013.01); *E05B 81/42* (2013.01); *E05B 81/46* (2013.01); *E05B 81/50* (2013.01); *E05B 81/64* (2013.01)

(58) Field of Classification Search
CPC ..... E05B 81/02; E05B 81/04; E05B 81/06; E05B 81/14; E05B 81/16; E05B 81/30;
(Continued)

(56) References Cited

U.S. PATENT DOCUMENTS 8,757,682 B2 * 6/2014 Scholz ..... E05B 81/14 292/201
2008/0224482 A1 * 9/2008 Cumbo ..... E05B 77/02 292/216

FOREIGN PATENT DOCUMENTS

DE 19710531 9/1998
DE 19725416 1/1999
(Continued)

OTHER PUBLICATIONS

Sep. 17, 1998 Machine translation of DE19710531A1 (Year: 1998).*
(Continued)

*Primary Examiner* — Christine M Mills
*Assistant Examiner* — Christopher F Callahan
(74) *Attorney, Agent, or Firm* — Renner, Otto, Boisselle & Sklar, LLP

(57) ABSTRACT

A motor vehicle lock, preferably an electrically actuatable motor vehicle lock, comprising a locking mechanism with a rotary latch and at least one pawl, a release lever, an electric drive unit, wherein the release lever can be actuated by the electric drive unit, and the locking mechanism can be unlocked by the release lever, also comprising a release aid, wherein additional momentum for unlocking the locking mechanism can be guided into the locking mechanism by means of the release aid, the additional momentum can be generated using the electric drive unit.

15 Claims, 3 Drawing Sheets

Figure 1:
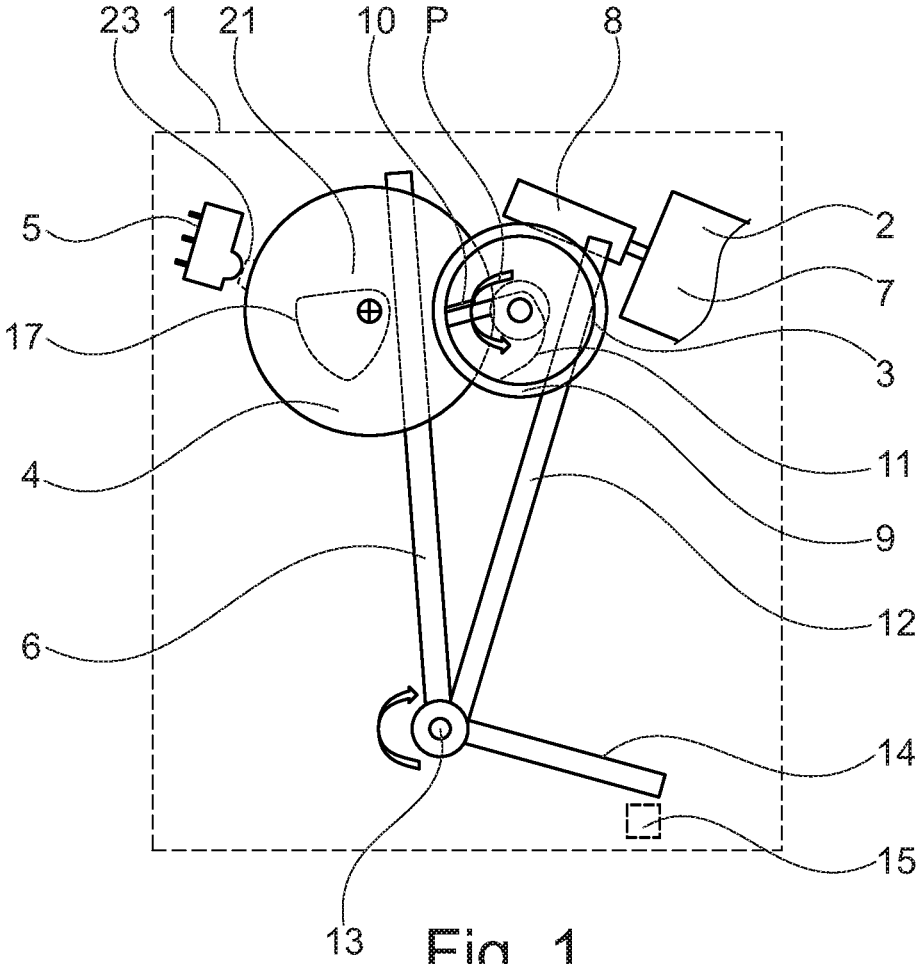

(51) Int. Cl.

| | |
|---|---|
| ***E05B 81/14*** | (2014.01) |
| ***E05B 77/02*** | (2014.01) |
| ***E05B 81/42*** | (2014.01) |
| ***E05B 81/46*** | (2014.01) |
| ***E05B 81/64*** | (2014.01) |
| ***E05B 81/34*** | (2014.01) |

(58) Field of Classification Search
CPC ..... E05B 81/34; E05B 81/42; E05B 81/46; E05B 81/50; E05B 81/64; E05B 81/72; E05B 81/74; E05B 77/02; Y10T 292/1047; Y10T 292/1082; Y10S 292/23
See application file for complete search history.

(56) References Cited

FOREIGN PATENT DOCUMENTS

| | | | | |
|---|---|---|---|---|
| DE | 19935589 | | 2/2001 | |
| DE | 10327450 | | 1/2005 | |
| DE | 102014223718 | | 5/2016 | |
| DE | 102015205345 | | 9/2016 | |
| DE | 102015113359 | | 2/2017 | |
| EP | 1074681 | | 2/2001 | |
| EP | 1253268 | | 10/2002 | |
| EP | 2826938 | | 1/2015 | |
| FR | 2919647 | A1 * | 2/2009 | ..... E05B 81/20 |
| WO | WO-0015932 | A1 * | 3/2000 | ..... E05B 81/20 |
| WO | WO-03006769 | A1 * | 1/2003 | ..... E05B 81/14 |

OTHER PUBLICATIONS

Feb. 6, 2009 machine translation of FR2919647 (Year: 2009).*
Feb. 7, 2001 Machine translation of EP1074681A1 (Year: 2001).*
International Search Report and Written Opinion for corresponding Patent Application No. PCT/DE2017/100495 dated Oct. 20, 2017.
Search Report of DE Application No. 10 2016 112 185.1 dated Apr. 26, 2017.

* cited by examiner

MOTOR VEHICLE LOCK

The invention relates to a motor vehicle lock, preferably an electrically actuatable motor vehicle lock, comprising a locking mechanism with a rotary latch and at least one pawl, a release lever, an electric drive unit, wherein the release lever can be actuated by the electric drive unit and the locking mechanism can be unlocked by the release lever, also comprising a release aid, wherein additional momentum for unlocking the locking mechanism can be introduced into the locking mechanism by means of the release aid.

Today's motor vehicles are equipped with functional elements that make it easier to operate the vehicle and thus increase comfort. A comfort function for a motor vehicle locking system and in particular a motor vehicle lock is that the locking system or lock is electrically actuated. Known examples are an electrically operated central locking system and an electric opening system. When a motor vehicle lock is electrically opened, the locking mechanism is opened by means of an electric drive.

Preferably, motor vehicle locks have a locking mechanism consisting of a rotary latch and at least one pawl. A lock holder can be fixed by means of the rotary latch and thus a door or flap can be held in its closing position. When electrically opened, the locking mechanism is unlocked from the locked position by means of an electric drive. The operator can, for example, use a radio remote control or an external door handle to generate an electrical signal that causes the electric drive to open the lock.

The unpublished DE 10 2015 205 345.8 describes an operating device for an electric motor vehicle lock with a spring mechanism. The publication reveals a motor vehicle lock with a locking mechanism consisting of a rotary latch and a pawl. The pawl can be opened by means of an electric motor and a worm gear drive. The worm drive has a gear to which a bolt is attached, whereby when the gear rotates, the bolt engages the pawl and unlocks the lock. The lock can thus be opened electrically.

In particular, in cases where an increased force is needed to unlock the locking mechanism, there may be instances where the drive unit consisting of worm drive and gear cannot provide sufficient force to unlock the locking mechanism. This can occur, for example, in an accident where the motor vehicle lock is clamped or jammed under high load. In this case it must be possible to provide an increased force to unlock the locking mechanism and disengage the pawl from the rotary latch engagement area.

DE 10 2015 205 345.8 describes a spring mechanism for emergency actuation which allows an additional momentum for unlocking the locking mechanism to be introduced into the locking mechanism. A spring mechanism arranged on a rear side of the gear wheel for releasing the locking mechanism can generate or release an additional momentum by means of an electric drive, a gear stage and a lever, so that a momentum can be generated from the spring mechanism for emergency actuation and provision of an increased force.

If the electrical opening mechanism is activated and the locking mechanism is not opened, this can be detected, for example, by the fact that the rotary latch has not moved into the opening position. In this case, the additional drive is used to actuate the gearbox and the lever is set in motion. The lever then releases the spring mechanism, which is then able to apply an additional momentum into the gear wheel and thus initiate an additional momentum onto the bolt to move the pawl. The lock thus can be operated in an emergency.

Another electrically operated motor vehicle lock has become known from DE 10 2014 223 718.1. To electrically open a locking mechanism, the electrical opening mechanism also has a worm gear with a gearwheel on which a bolt is located, and the bolt can move the pawl out of the rotary latch engagement area.

If an electrical momentum is now generated to open the locking mechanism, the electric motor drives the worm wheel, whereby the gear wheel swivels clockwise and initiates a momentum into the pawl by means of the bolt. If the momentum is not sufficient to unlock the locking mechanism, this is detected, for example, by the fact that the rotary latch has not reached its opening position. This can be achieved, for example, with a limit switch on the rotary latch. In this case, when the locking mechanism does not open, a mass inertia element meshing with the gear wheel is used. The gear wheel is moved counterclockwise and then moved at increased speed and/or travel to move a mass inertia element meshing with the gear wheel to a home position. The motor then moves the gear again clockwise, accelerating the pivoting mass inertia element and generating an additional momentum when the bolt hits the pawl. An additional momentum to open the locking mechanism can thus be generated.

The disadvantage of state-of-the-art solutions is that additional motors or additional mass elements are required to generate a momentum. Especially additional motors require additional electrical contacts, which in turn leads to additional costs.

The object of the invention is to provide an improved motor vehicle lock. In addition, it is the task of the invention to provide a motor vehicle lock that can enable a safe opening of a locking mechanism even in emergency situations with the smallest possible number of electric drives. Furthermore, it is the task of the invention to provide a constructively simple and cost-effective option for a motor vehicle lock and in particular an electrically operated motor vehicle lock.

The object is achieved according to the invention by the characteristics of the independent patent claim 1. Advantageous designs of the invention are specified in the subclaims. It should be noted that the examples of design versions described below are not restrictive; rather, any variation of the characteristics described in the description and in subclaims is possible.

According to patent claim 1, the task of the invention is solved by providing a motor vehicle lock, preferably an electrically operable motor vehicle lock, comprising a locking mechanism with a rotary latch and at least one pawl, a release lever, an electric drive unit, wherein the release lever can be actuated by means of the electric drive unit and the locking mechanism can be unlocked by means of the release lever, a release aid, wherein an additional momentum for unlocking the locking mechanism is introduced into the locking mechanism by means of the release aid. The additional momentum can be generated using the electric drive unit. The invention-based design of the motor vehicle lock now makes it possible to provide an additional momentum for unlocking the locking mechanism using only the smallest possible number of electric drives. Here, no further electric drives are required and the electric drive unit, by means of which the release lever can be actuated, is used directly to generate the momentum. The electric drive unit thus has a double function: on the one hand, it actuates the release lever to open the locking mechanism and, on the other hand, it generates an additional momentum which makes it possible to open the lock even in cases where a higher release force is required to unlock or open the lock.

When reference is made to motor vehicle locks in relation to the invention, they are preferably to be understood as meaning those locks which permit electrical actuation, that is to say electrical opening of the locking mechanism. The locking mechanism consists of a rotary latch and at least one pawl and is designed in such a way that the locking mechanism can be unlocked by means of a release lever. The locking mechanism is usually locked by means of a locking bolt which can be engaged with the rotary latch.

If, for example, a tailgate or a motor vehicle door is in an open position, when the tailgate or door is closed, the rotary latch in an opening position comes into contact with a locking bolt or lock holder. When the door continues to close, it moves to the closed position, where the pawl engages with the rotary latch and locks the rotary latch in a closed position. One- or two-stage locking mechanisms are used for this purpose. In the case of a two-stage locking mechanism, locking can take place in a pre-latching as well as in a main latching position. To open the locking mechanism electrically or to unlatch the locking mechanism, a release lever actuates the pawl directly or indirectly so that the pawl disengages from the rotary latch.

In particular, in cases where a higher force is applied to the locking mechanism, such as in an accident where the locking mechanism is under high stress, for example, or when the movement of the locking mechanism is inhibited due to soiling or icing. In these cases, a higher release force must act on the pawl or the release lever to electrically open the locking mechanism. Preferably, an electric motor with one or more gears is indirectly or directly connected to the release lever. By electrically actuating the electric motor, the pawl can be disengaged from the rotary latch. In order to exert an additional momentum on the locking mechanism or the release lever opening the locking mechanism, the drive unit is designed in such a way that an additional momentum can be generated by the drive unit in addition to the pure opening momentum.

In an advantageous design of the invention, the release aid can be operated directly by the electric drive unit. The direct operation of the release aid offers the advantage that the introduction of force can be controlled very precisely. In addition, the direct operation of the release aid offers the advantage that a momentum can be applied to the release unit with the smallest possible number of components.

If the release aid can be operated indirectly via at least one gear stage, this results in another advantageous design version of the invention. By using a gear stage, the force acting on the release lever can be defined. In particular, a translation can be achieved which doubles or multiplies the force exerted by the drive unit. It is also possible to design the gearbox in such a way that very high release speeds can be achieved. In the case of a large transmission ratio, only very slow release movements can be achieved, but it is possible to introduce very high forces into the release lever and thus the pawl.

In another advantageous design version of the invention, there is an advantage if the release aid can be driven indirectly by the drive of the release lever. In an advantageous way, the release lever drive can be used to actuate the release aid. The release aid may be designed in such a way that the release lever is part of the release aid. This in turn offers the advantage that an additional momentum can be generated with the smallest possible number of components.

If the electric drive unit can be operated in a direction opposite to that of the release lever in order to generate an additional momentum, this results in a further design version of the invention. Operating the electric drive unit in the opposite direction to the actuation of the release lever can achieve increased safety and easy control. If, for example, the drive unit is actuated in a first direction, for example a clockwise direction, in order to actuate the release lever, and the locking mechanism cannot be unlocked, this can be detected, for example, by a switch querying the rotary latch position. In this case, the controller detects that the locking mechanism cannot be opened by means of a normal opening momentum. Now, the controller controls the drive unit in an opposite direction, for example in an end direction that is counterclockwise. This makes it very easy to control the release momentum. In particular if, for example, the locking mechanism cannot be opened by the usual release momentum, a larger momentum can be generated by operating the release aid in an opposite direction, for example by using a gear stage.

In a further design version of the invention, an advantage arises if the release lever has at least a first lever arm working with the drive unit and a second lever arm acting on the locking mechanism, a further lever arm being provided which works with the release aid, the further lever arm being connected in a non-twisting manner at least to the second lever arm. By dividing the release lever into a first and a further lever arm, which acts on the second lever arm, it is possible to apply different torques to the second lever arm by means of a drive. Here it is conceivable that the drive unit is arranged in such a way that a different moment can be applied to the second lever arm solely by the arrangement of the lever arms, i.e., the first lever arm and the further lever arm.

If the further lever arm can be operated by means of a gear stage and the drive unit, another advantageous design version of the invention results. If a gear stage is arranged between the drive unit and the further lever arm, a torque can be set very precisely to apply to the second lever arm. In particular, it is possible—depending on the transmission ratio and the connection of the gear stage to the first lever arm and the second lever arm—to apply different forces to the second lever arm with one motor. It is also possible that, depending on the direction of rotation of the motor, the first lever arm on the one hand and the further lever arm on the other hand can be actuated.

If, for example, when the electric drive unit moves in a first direction of rotation, the first lever arm is actuated via a first gear stage, the other lever arm may be freewheeling with respect to this movement of the first gear stage. In other words, the first lever arm is actuated by the first rotary movement of the electric drive, so the further lever arm remains unactuated. If, for example, a further gear stage is connected to the first gear stage which ensures freewheeling with a first direction of rotation of the electric drive, the further gear stage can come into contact with the further lever arm with a direction of rotation opposite to the first direction of rotation and operate the second lever arm. Especially by connecting the first gear stage to the further gear stage to apply a torque or force to the further lever arm, a large torque can be exerted on the second lever arm. Preferably the second lever arm is the release lever, which interacts directly or indirectly with the locking mechanism and preferably acts directly on the locking mechanism.

A gear ratio between the drive unit and the other lever arm can be achieved, for example, with a ratio of 1:6. If, for example, a force of 440 Newton is transmitted to the first lever arm via the first gear stage by means of the drive unit, the design of the first and further gear stages can provide a very high force of 5,000 N in the further lever arm, for example, or, depending on the transmission ratio of the lever arms, a force of 5,000 N on the second lever arm for triggering the locking mechanism. Thus, on the one hand, very fast opening in normal operation can be achieved via the first gear stage, whereas in an emergency, i.e., in the event of an accident, a very high force can be provided. In normal operation, for example, an opening can take place within a time window of t=30 ms, whereas the opening time in emergency operation plays a subordinate role. According to the present invention, a different torque is generated on two differently reduced gears, especially load paths, depending on the direction of rotation of the drive unit.

In an advantageous design version of the invention, the further lever arm can be driven by means of a cam drive. The application of a torque or a force on the further lever arm by means of a cam drive offers several advantages. On the one hand, a cam drive can be used to determine a torque curve which, for example, generates an increasing torque, and on the other hand, a cam drive can be used to realize a freewheel at the further lever arm. The freewheel must then be arranged on the further gear stage in such a way that when the first gear stage is actuated, the cam drive remains out of contact with the further lever arm. This means that the first lever arm can be operated via the electric drive unit and, for example, via a first cam disc assigned to the first lever arm, whereas when the first lever arm is actuated, the cam drive of the other lever arm does not engage with the other lever arm. Only when operating the electric motor of the drive unit in a drive direction opposite to the first gear stage does the cam drive of the further lever arm come into contact with the further lever arm and can thus actuate the second lever arm or the release lever.

If the drive of the further lever arm has a freewheel so that no movement can be introduced into the further lever arm when the second lever arm, in particular the release lever, is operated, this results in a further advantageous design version of the invention.

A freewheel at the further lever arm can be achieved, for example, by arranging a cam drive on the further gear stage or the gear wheel actuating the second lever arm. The cam drive is connected to the further gear stage or the gear wheel in such a way that the cam drive does not engage with the further lever arm during a movement of the first gear stage. Depending on the gear ratio, the freewheel can, for example, be angular movement of 25° on the drive wheel of the other lever arm. This 25° freewheel can be realized, for example, with a gear ratio between the first gear stage and the further gear stage of 1:6.

In a preferred design version, the first gear stage of the release lever drive may have a coupling means, so that the first gear stage can be disengaged in case of a further lever arm drive. A coupling means in the first gear stage and between the electric drive and a first cam drive of the first gear wheel for introducing the force into the first lever arm offers the advantage that the gear stages can be operated independently of each other with regard to the transmission ratios. For example, when the gear of the first gear stage is driven by the electric drive, the coupling unit allows the first gear stage to run freely, i.e., the first gear stage rotates, but no force is transferred to the first lever arm, whereas the first gear stage is able to actuate the further gear stage. The freewheel or the coupling means in the first gear stage towards the electric drive offers the possibility that the gear wheel of the first gear stage can be turned several times completely by means of the electric drive without a force being applied to the first lever arm. This means that a very large force can be generated in the further lever arm, since the multiple turning of the first gear stage can result in a very high transmission ratio in the further gear stage. A transmission ratio of 1:4 to 1:8 is considered advantageous. A gear ratio of 1:6 between the first gear stage and the following gear stage is considered to be particularly advantageous.

If at least one switching device is provided, it being possible for the drive unit to be initialized by means of the switching device, so that a starting position of the drive unit can be determined, a further design version of the invention results. If the further gear stage has been used in an emergency operation and the release lever has been actuated, the first gear stage has been swiveled several times by 360°. In order to move the first gear stage to a starting position from which the release lever can be released in a very short time, for example in t=30 ms, during normal operation, a switching device can be arranged on the first gear stage and preferably on the next one. By means of the switching device, the first or further gear stage can be moved back into an initial position or starting position after an emergency actuation, so that, on the one hand, the coupling means engages with the first gear stage in such a way that the first gear stage can be actuated again and, on the other hand, the further gear stage comes into an initial position in which freewheeling for actuating the first gear stage is possible.

To enable the first gear stage to be actuated in a first actuating direction and the further gear stage to be driven in a further actuating direction by means of just one drive unit, a return spring can be provided on the actuating wheel of the first gear stage. If, for example, the first gear stage is activated in normal operation and the first lever arm is deflected, the return spring can return the first gear stage to its initial position after the electric drive has been switched off. Thus, a simple construction is possible and a separate control of the electric drive for resetting is not absolutely necessary.

An advantageous design version of the invention arises when a spring-loaded lever arm is mounted in the motor vehicle lock in a guided manner. The spring-loaded lever arm makes it possible to replace a switching device or initialize the position of the gear stages. The spring-loaded lever arm is used as a stop so that it is possible to stop the gear stages, in particular at least one of the gear wheels. The stop position can represent an initialization position.

If the lever arm has a first extension that can be brought into engagement with a stop and/or a control contour of the second gear stage, a further design version of the invention results. The second gear stage, for example, is driven clockwise to enable emergency opening of the motor vehicle lock. For initialization, i.e., to bring the motor vehicle lock back to an initial or starting position, the second gear stage is then operated counterclockwise. The drive continues until the second gear stage moves against the stop or comes into contact. This initialization position can then be used for normal opening of the lock. During normal opening, the first extension can then engage with the control contour, whereby the control contour allows the spring-loaded lever arm to be positioned.

In an advantageous way, the spring-loaded lever arm can have a second extension, which can be engaged with another stop of the first gear stage. A further stop on the spring-loaded lever arm enables the lever arm to be moved and/or pivoted. If the spring-loaded lever arm is in the initialization position, the spring-loaded lever arm can be moved to its initial position by means of the second extension in interaction with the further stop.

In another design version of the invention, the lever arm can be loaded in the direction of the stop by means of a compression spring and in the direction of the further stop by means of a tension spring. Due to the spring load on the lever arm, the lever arm can be guided independently in the housing of the motor vehicle lock. Advantageously, the lever arm has an elongated opening and is displaceably mounted in the opening. It is therefore possible with the spring-loaded lever arm to dispense with a switching device for initializing the motor vehicle lock.

In the following, the invention is explained in more detail with reference to the attached drawings using a preferred design version example. However, the principle applies that the exemplary embodiments do not restrict the invention, but only constitute advantageous embodiments. The illustrated characteristics can be executed individually or in combination with further characteristics of the description and also the patent claims individually or in combination.

The following are shown:

FIG. 1: An exemplary embodiment of an electric drive for generating a momentum on a release lever in normal operation and in emergency operation, whereby a first and a further gear stage with a lever mechanism is shown, FIG. 2: Another view of the electric drive for the operation of the release lever in a plan view, FIG. 3: A view of the first gear stage and in particular of an example of a coupling means, FIG. 4: Another view of the first gear stage with a first cam disc to actuate the first lever arm and a return spring, FIG. 5: A further three-dimensional view of the first gear stage with electric drive, return spring and first cam drive to actuate the first lever arm, FIG. 6: Another embodiment of the invention in a sketch of principle, with a spring-loaded lever arm, wherein the spring-loaded lever arm enables initialization of the gear stages.

FIG. 1 shows a motor vehicle lock 1 as a dashed line. The motor vehicle lock 1 has an electric drive unit 2, a first gear stage 3, a further gear stage 4, a switching device 5 and a lever arrangement 6.

The electric drive unit 2 comprises an electric motor 7 which drives a worm wheel 8. The worm gear meshes with a toothing of a first gear 9 of the first gear stage 3. The first gear wheel 9 can be operated in the direction of the arrow P by the electric drive unit 2 and the worm wheel 8. If the first gear wheel 9 is driven in the direction of arrow P, a cam 10 meshes with a first cam drive 11. The cam drive 11 is then moved in the direction of the first lever arm 12 and thus moves the lever assembly 6. The first lever arm 12 is connected in a non-twisting manner to a release lever 14 via a rotary axis 13. The release lever 14 can act directly on a locking mechanism 15. Using the release lever 14, the locking mechanism 15 can then be unlocked and the motor vehicle lock 1 can be opened.

The first gearwheel 9 of the first gear stage 3 is integrally formed with a circumferential toothing 16, for example, in one piece, which meshes with the next gear stage 4. The meshing ratios between the toothing 16 and the further gear stage 4 can be clearly seen in FIG. 2. The further gear stage 4 again has a cam drive 17, which can engage with the further lever arm 18 of the lever arrangement 6. The further lever arm 18 is connected in a non-twisting manner with the lever arrangement 6 and in particular with the release lever 14.

Figure 2:
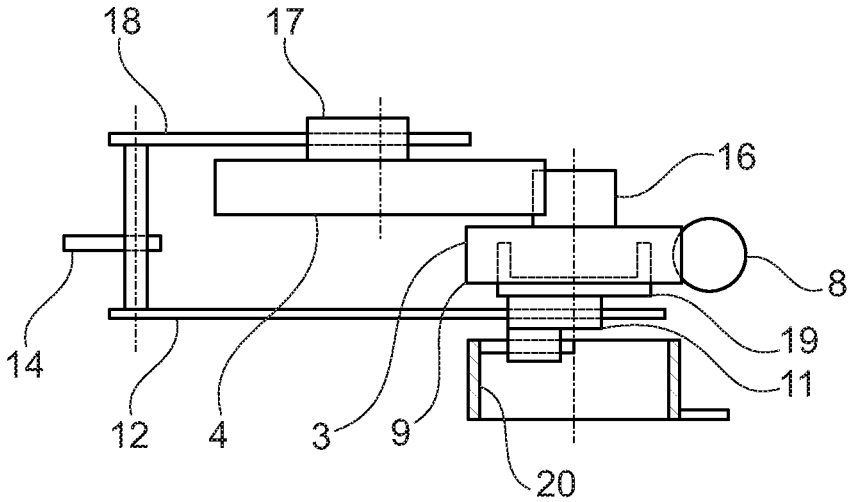

As can be clearly seen in FIG. 2, the worm wheel 8 meshes with the first gear stage and in particular with the first gear wheel 9. The first lever arm 12 is actuated or swivelled via the first cam drive 11 in order to quickly open the release lever 14 in normal operation. For this purpose, the first cam drive 11 is connected to the first gear wheel via a coupling means 19. Here, the coupling means 19 has the effect that only in the drive direction shown in FIG. 1, which is shown with the arrow P, can the first cam drive 11 be subjected to a torque or rotary motion. After the first cam drive 11 has been subjected to a release force to open the locking mechanism 15, drive unit 2 is switched off and a return spring 20 moves the first gear stage 3 back to its initial position.

During this opening process, the further gear stage 4 meshes with the toothing 16. However, the rotary motion of the first gear stage 3 is selected in such a way that the rotary motion to open the locking mechanism 15 prevents the further cam drive 17 from engaging with the further lever arm 18. In addition, the cam drive 17 has a freewheel 21, which can, for example, be between 15° and 35°, preferably 25°. When the motor vehicle lock 1 is actuated normally, only the first lever arm 12 is actuated via the first cam drive 11 and the locking mechanism 15 is opened.

Figure 3:
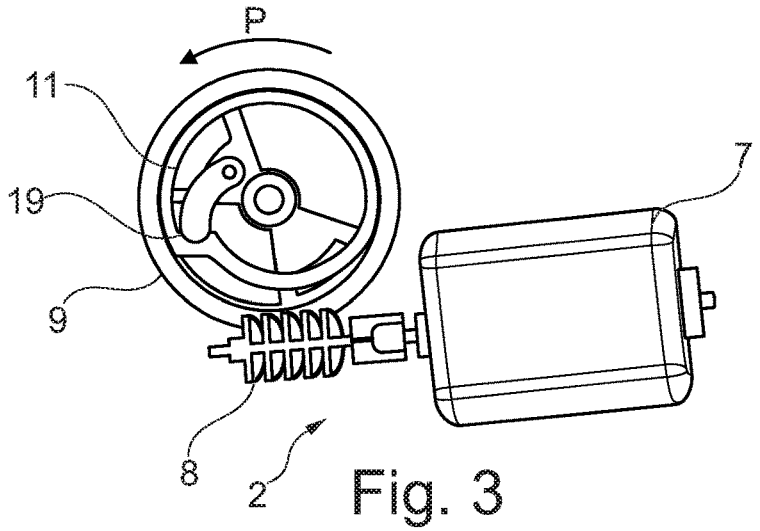

FIG. 3 shows a detailed view of the electric drive unit 2 with the electric motor 7 and the worm wheel 8, whereby the worm wheel 8 meshes with the first gear stage 3 and in particular the first gear wheel 9. A section through the first cam drive 11 is shown so that the coupling means 19 arranged inside the first cam drive 11 can be seen. As can be clearly seen in FIG. 3, a moment is applied to the first cam drive 11 by means of the first gear 9 only when the first gear 9 moves in the direction of the arrow P, counterclockwise as shown in the example shown.

If, on the other hand, the first gear wheel 9 is moved clockwise, the coupling 19 runs freely. In this case, a torque can be transmitted to the next gear stage 4 by means of the first gearwheel 9 and by means of the toothing 16. By means of the coupling means 19, it is possible to achieve very large gear ratios, since the first gear wheel 9 can be moved clockwise as often as required, without a torque being transmitted to the first cam drive 11. The first cam drive 11 runs freely when the first gear wheel 9 is actuated by means of the electric drive unit 2.

Figure 4:
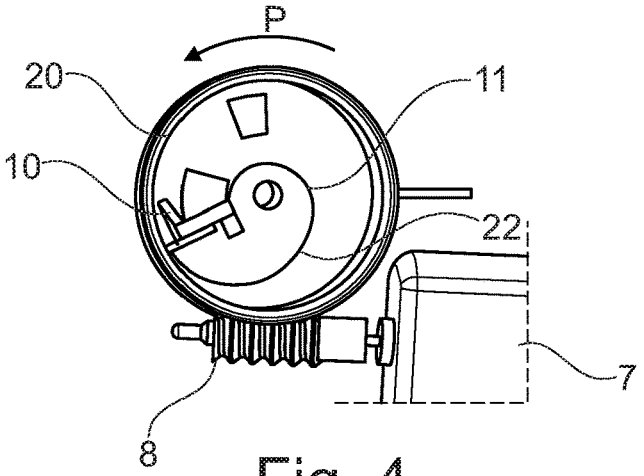

FIG. 4 shows a view of the first cam drive 11 and the return spring 20. The cam 10 meshes with the first cam drive 11. The return spring 20 has reset the cam drive 11 to the start position shown in FIG. 4, so that it is possible to open the locking mechanism 15 from the start position shown.

If now the first gear wheel 9 and thus the cam 10 is moved, a torque is applied to the first cam drive 11 and a first lever arm 12 can engage with the contour 22 of the first cam drive 11, so that the release lever 14 can be actuated.

Figure 5:
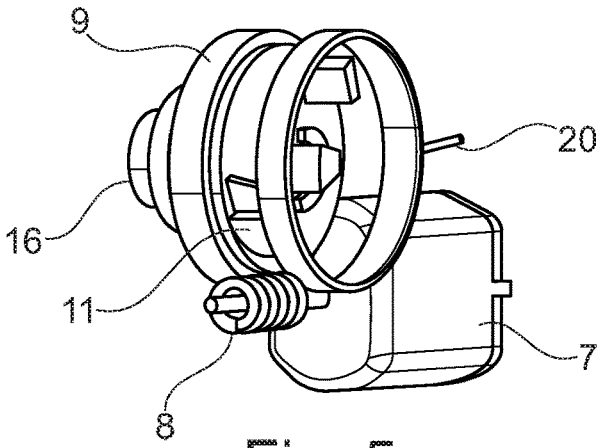

FIG. 5 shows the first gear stage 3 according to FIG. 4 in a three-dimensional view and in a representation swiveled towards FIG. 4. The meshing ratios between the electric drive 2 and the first gear stage 3 as well as the arrangement of a possible exemplary embodiment of a return spring 20 can be clearly seen.

It should be noted that the coupling means 19 shown is not limited to the depicted design form, but that several types of couplings, such as a slipping coupling, a wrap spring coupling, etc., can also be used. The preferred coupling means allows the first gear stage 3 to actuate only the further gear stage 4 in one operating direction, so that a large transmission ratio can be achieved. The example of the design version of the invention shown here makes it possible to apply different forces to a release lever 14 with just one drive 2.

FIG. 1 also shows a switching cam 23, which enables the gear stages 3 and 4 to be initialized after an emergency opening. If, in case of a temperature-induced block, contamination and/or due to an accident, the first gear 3 does not generate sufficient force, or does not provide sufficient moment to unlock the locking mechanism 15 and thus to open the motor vehicle lock 1, the further gear stage is used. In this case, a reversal of drive unit 2 is initiated by means of a control unit which, for example, evaluates a switching device on the locking mechanism. The electric motor 7 is energized in such a way that the second gear stage 4 is used. The first gear stage 3 runs freely due to the coupling means 19 and the further cam drive 17 engages in the further lever arm 18. In this case, a much higher torque can be applied to the release lever 14 via the second gear stage 4 via the further lever arm 18 and the motor vehicle lock 1 can be opened or operated with high force.

In order to return the motor vehicle lock 1 and in particular the gear stages 3, 4 to the initial position, i.e., to a position from which normal operation is possible, after an emergency opening or emergency actuation, a switching device 5 on the second gear stage 4 can be provided in one design version of the invention. After an emergency actuation, the second gear stage 4 is moved until a switching cam 23 engages with the switching device 5. When the switching position of gear stage 4 is reached, gear stages 3 and 4 have assumed their initialization position, so that normal opening can be initiated. The initialization position corresponds to the starting position of the motor vehicle lock 1, as shown in FIG. 1.

Figure 6:
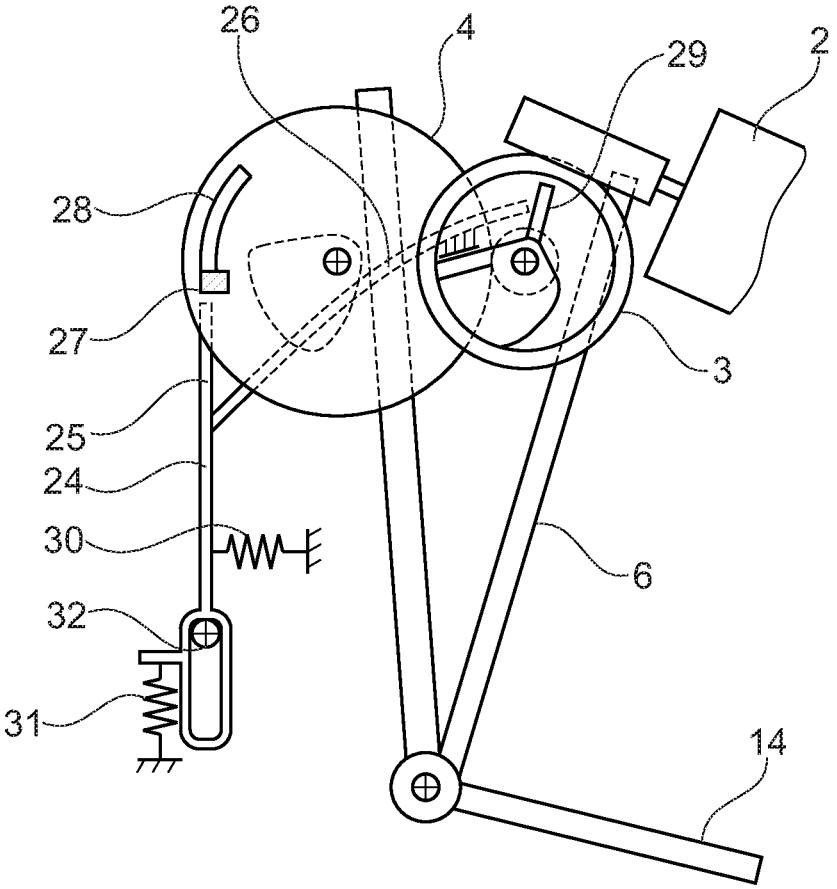

FIG. 6 shows in principle a further embodiment of the invention. Same parts or parts performing the same function are marked with the same reference symbols.

The design according to FIG. 6 shows an alternative design for initializing the motor vehicle lock 1. A spring-loaded lever arm 24 has two extensions 25, 26. A first extension 25 works together with a stop 27, wherein the stop 27 is firmly connected with the further gear stage 4. This means that the stop 27 can exert a holding torque on the second gear stage 4, whereby a force can be applied to the extension 25 of the spring-loaded lever arm 24. In addition, the further gear stage 4 has a control contour 28, which can be meshed with extension 25.

The second extension 26 can be engaged with a further stop 29 at the first gear stage 3. The further stop 29 is firmly connected to the first gear stage 3. This means that the stop 29 can exert a holding torque on the first gear stage 3, whereby a force can be applied to the extension 26 of the spring-loaded lever arm 24.

The spring-loaded lever arm 24 is preferably designed in one piece. In particular, a spring-loaded lever arm 24 made of plastic can be manufactured.

After an emergency actuation, initialization can take place by means of the spring-loaded lever arm 24. If an emergency actuation has taken place, the motor vehicle lock 1 must be reset to the start or starting position in order to enable normal actuation of lock 1. To do this, move or turn the second gear stage 4 counterclockwise until the stop 27 engages with the extension 25 as shown in FIG. 6.

If the locking mechanism 15 is unlocked from the initialization position shown in FIG. 6, the second extension 26 engages with the further stop 29. The further stop 29 moves the spring-loaded lever arm 24 against the direction of tension of a tension spring 30 and by means of the force of a compression spring 31 over a pivot axis 32 to such an extent that the first extension 25 engages with the control contour 28. To return to the initial position, the tension spring 30 and the compression spring 31 act on the spring-loaded lever arm 24, whereby the lever arm 24 is mounted in the motor vehicle lock so that it can be guided.

In accordance with the design of FIG. 6, a switching device 5 is not required for initialization, as the initial position can be safely and reproducibly reached by controlling the drive unit 2.

LIST OF REFERENCE SYMBOLS

1 Motor Vehicle Lock
2 Electric drive unit
3 First gear stage
4 Further gear stage
5 Switching device
6 Lever assembly
7 Electric motor
8 Worm wheel
9 First gear
10 Cam
11 First cam drive
12 First lever arm
13 Axis of rotation
14 Release lever
15 Locking mechanism
16 Gearing
17 Further cam drive
18 Further lever arm
19 Coupling means
20 Return spring
21 Freewheel
22 Contour
23 Switching cams
24 Spring-loaded lever arm
25 First extension
26 Second extension
27 Stop
28 Control contour
29 Further stop
30 Tension spring
31 Compression spring
32 Swivel axis
P Arrow

The invention claimed is:

1. A motor vehicle lock that is electrically actuatable, the motor vehicle lock comprising:

a locking mechanism with a rotary latch and at least one pawl;

a release lever;

an electric drive unit, wherein the release lever is actuated by the electric drive unit and the locking mechanism is unlocked by the release lever; and a release aid, wherein additional momentum for unlocking the locking mechanism is introduced into the locking mechanism by the release aid, wherein the additional momentum is generated using the electric drive unit, wherein the release lever has a first lever arm interacting with the drive unit and a second lever arm acting on the locking mechanism, a further lever arm being provided which interacts with the release aid, the further lever arm being connected at least to the second lever arm in a non-twisting manner;

wherein the electric drive unit incudes a first gear stage that interacts with the first lever arm of the release lever, and the release aid includes a second gear stage that interacts with the further lever arm, wherein the first gear stage meshes with the second gear stage; and wherein the first gear stage includes a first gear wheel and toothing that extends from the first gear wheel, the first gear wheel being positioned in a different plane of rotation from the second gear stage, and the second gear stage meshes with the toothing of the first gear stage.

2. The motor vehicle lock according to claim 1, wherein the release aid is actuated directly by the electric drive unit.

3. The motor vehicle lock according to claim 1, wherein the electric drive unit is driven in a direction opposite to that of the release lever in order to generate the additional momentum.

4. The motor vehicle lock according to claim 1, wherein the further lever arm is driven by a cam drive that is part of the second gear stage.

5. The motor vehicle lock according to claim 4, wherein the cam drive that drives the further lever arm has a freewheel to prevent movement from being introduced into the further lever arm when the release lever is operated.

6. The motor vehicle lock according to claim 1, further comprising at least one switching device that is configured to move the drive unit to a starting position.

7. The motor vehicle lock according to claim 1, further comprising a spring-loaded lever arm that is accommodated in the motor vehicle lock in a guided manner.

8. The motor vehicle lock according to claim 7, wherein the spring-loaded lever arm lever arm has a first extension that is brought into engagement with a stop and/or a control contour of a second gear stage.

9. The motor vehicle lock according to claim 8, wherein the spring-loaded lever arm has a second extension which can be brought into engagement with a further stop of the first gear stage.

10. The motor vehicle lock according to claim 9, wherein the lever arm is loaded by a compression spring in a direction of the stop and by a tension spring in a direction of the further stop.

11. The motor vehicle lock according to claim 1, wherein the pawl is disengaged from the rotary latch when the electric drive unit actuated.

12. The motor vehicle lock according to claim 1, wherein when the electric drive unit moves in a first direction of rotation, the first lever arm is actuated via the first gear stage, and the further lever arm is configured to freewheel with respect to movement of the first gear stage.

13. The motor vehicle lock according to claim 1, wherein the first gear stage and the second gear stage have a gear ratio of 1:6.

14. The motor vehicle lock according to claim 1, further comprising a switching device arranged on the second gear stage.

15. The motor vehicle lock according to claim 14, further comprising a switching cam arranged between the second gear stage and the switching device.

* * * * *